United States Patent [19]

Limmergard et al.

[11] 4,236,670

[45] Dec. 2, 1980

[54] ARRANGEMENT AT A RAILROAD CROSSING

[75] Inventors: Sten Limmergard, Alvesta; Stig Thim, Växjöboth of Sweden

[73] Assignee: A-Betong AB, Växjö, Sweden

[21] Appl. No.: 948,561

[22] Filed: Oct. 4, 1978

[30] Foreign Application Priority Data

Oct. 7, 1977 [SE] Sweden ..... 7711266

[51] Int. Cl.[3] ..... E01C 9/04

[52] U.S. Cl. ..... 238/8; 238/30; 238/84

[58] Field of Search ..... 238/3, 299, 2–8, 238/29, 45, 30, 84; 14/28, 69.5

[56] References Cited

U.S. PATENT DOCUMENTS

| | | | |
|---|---|---|---|
| 1,598,584 | 8/1926 | Jones | 238/8 |
| 2,067,037 | 1/1937 | Alexander | 238/8 |
| 2,471,167 | 5/1949 | Oxenrider | 238/8 |
| 2,950,057 | 8/1960 | Speer | 238/8 |
| 2,984,417 | 5/1961 | Vorhees | 238/8 |
| 3,861,591 | 1/1975 | Rector | 238/8 |
| 3,984,891 | 10/1976 | Weinmann | 14/69.5 |

FOREIGN PATENT DOCUMENTS

| | | | |
|---|---|---|---|
| 1113952 | 9/1961 | Fed. Rep. of Germany | 238/8 |

*Primary Examiner*—Randolph A. Reese

[57] ABSTRACT

An arrangement at crossings between a road and a railway. Between the rails and the respective edges of the road structure and between the rails are arranged first and second slabs level at their top surfaces with the top surfaces of the rails and the top surfaces of the road structure. Elongated supporting elements rest on the foundation and are located at the edges of the first slabs which face the road structure. On the supporting element a first edge to which the road structure adjoins with a second edge opposite to the first edge of the supporting element, forming a support for the edges of the first slabs, and a support for the opposite edges of the slabs facing the rail is provided on the end portions of the sleepers outside the rails. The support on the sleepers is provided with surfaces engaging surfaces on the slab for locking the same in a direction perpendicular to the rail, which locking support is provided to permit a pivoting of the slab during vertical movements of the sleepers and said supporting element.

4 Claims, 5 Drawing Figures

ARRANGEMENT AT A RAILROAD CROSSING

Figure 1:
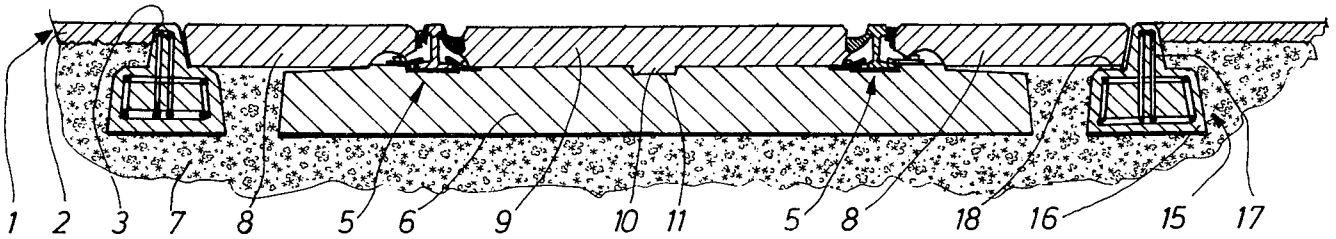

The present invention relates to an arrangement at crossings between roads and railways, where the road structure is interrupted between two edges, between which is positioned at least one railroad track comprising two rails supported by a row of sleepers arranged substantially perpendicular to the rails, said sleepers resting on a foundation slabs extend in the area between the rails and the respective edges of the road structure, and a slab, preferably divided up in sections in the longitudinal direction of the track being located between the rails forming the railroad track, which slabs are intended with their top surfaces to be level with the top surfaces of the rails and the top surfaces of the road structure.

At crossings between roads and railroads it is desirable that the respective vehicle shall have an unobstructed crossing on the road as well as on the railroad. As no obstacles can be permitted for the rail guided vehicle, interruptions of the paving of the road are necessary in order to permit the passage of the rails and provide accomodation for the wheel flanges running along the inwardly facing sides of said rails. In order to make the interruptions of the paving as insignificant as possible the paving in the crossing has to be kept as closely as possible in level with the rails and at the same time the accomodation space provided for the wheel flanges has to be as small as possible, so that it will be as insignificant as possible. The first mentioned aim can be difficult to obtain, as movements because of sinking in the ground are different in the paving compared with the rail bed. The other aim in a certain degree is contrary to the demand for good passage for the railroad vehicles. Thus a narrow groove for the flanges offers good passage and comfortable driving for road vehicles, but the railroad traffic requires that the groove be so wide that clogging by dirt and frozen particle lumps will not occur frequently and obstruct the necessary free space for the wheel flanges.

The arrangements in connection with crossings between roads and railways according to the prior art employ small elements such as wooden planks but nowadays usually small concrete slabs. This results in the drawback that said small elements easily will be displaced with respect to each other and will form an uneven paving. Further the manufacture as well as the application of such small elements means a considerable amount of manual work, which is not economical and raises the costs. Also renovations and more extensive cleaning work requires much manual work because of the great quantity of elements, which must be fitted together.

It is an object of the present invention to provide an arrangement in which a good passage for the vehicles of the railway as well as the road vehicles is obtained by means assuring the same level for the paving and the rails.

It is another object of the invention to provide an arrangement in which the free spaces along the rails for the wheel flanges are provided by means of a smooth crossing for road vehicles but will minimize the risk of clogging.

An object of the invention is also to provide a crossing arrangement, which is distinguished from conventional ones, by comprising a small number of large elements, which are economical with respect to their manufacture, application and maintenance.

It is also an object of the invention to provide a crossing arrangement in which the elements forming part of the same are fixed in correct positions so that fitting work is eliminated.

Still another object is to provide a crossing which does not need frequent maintenance and cleaning.

The objects of the invention are obtained by means of an arrangement including elongated supporting elements provided to rest on the foundation and located at the edges of the first mentioned slabs which face the road structure, on the supporting element a first edge to which the road structure adjoins, with a second edge opposite to the first edge of the supporting element, forming a support for said edges of the first slabs, and a support for the opposite edges of the slabs facing the rail provided on the end portions of the sleepers outside the rail, which support is provided with surfaces engaging surfaces on the slab for locking of the same in a direction perpendicular to the rail, which locking support is provided to permit pivoting of the slab for different vertical movements of the sleepers and said supporting element.

Figure 2:
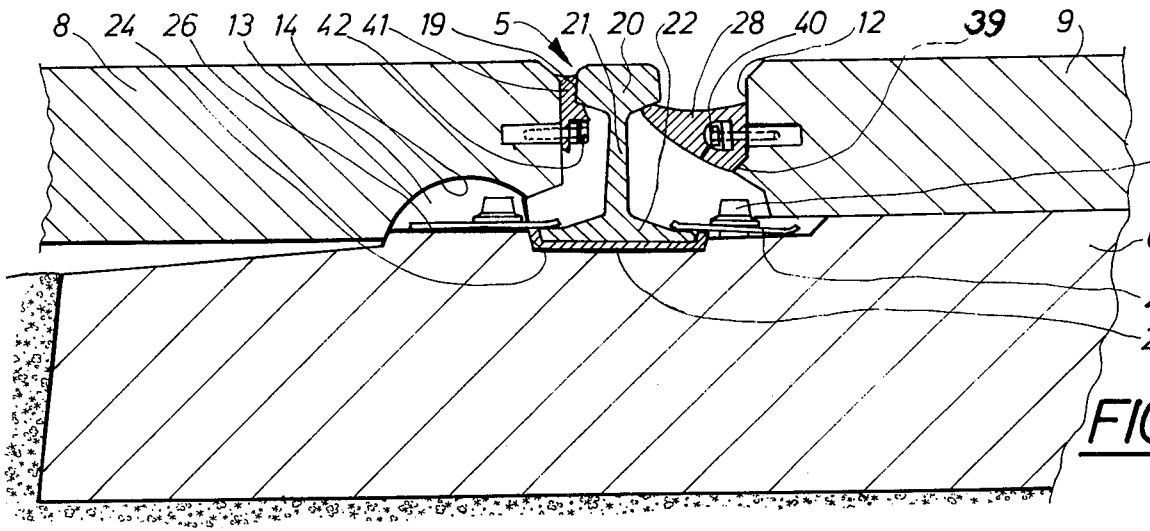
Figure 3:
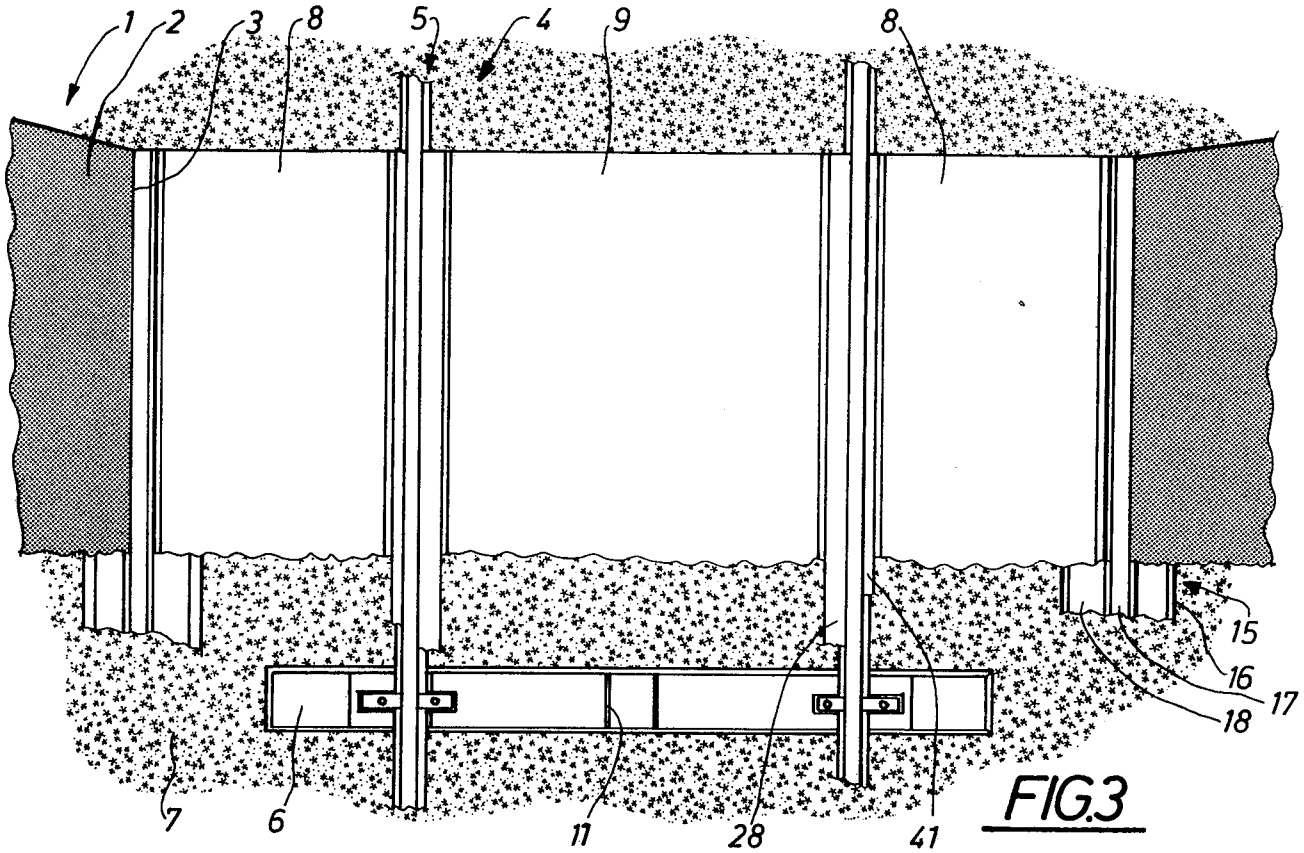
Figure 4:
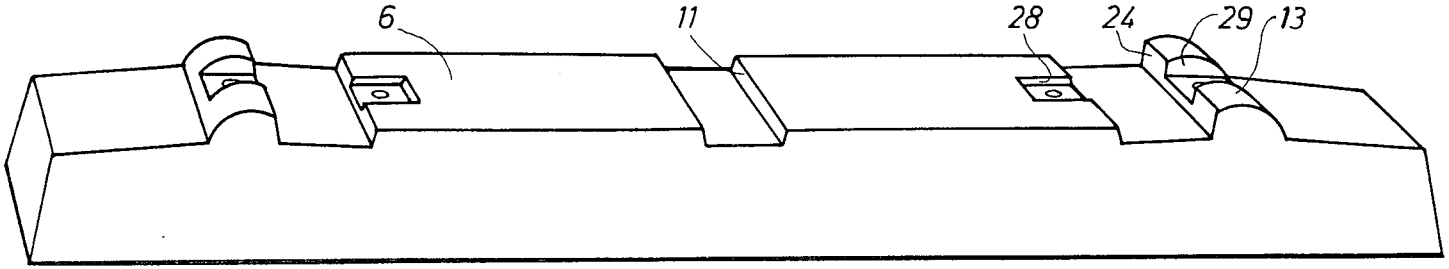
Figure 5:
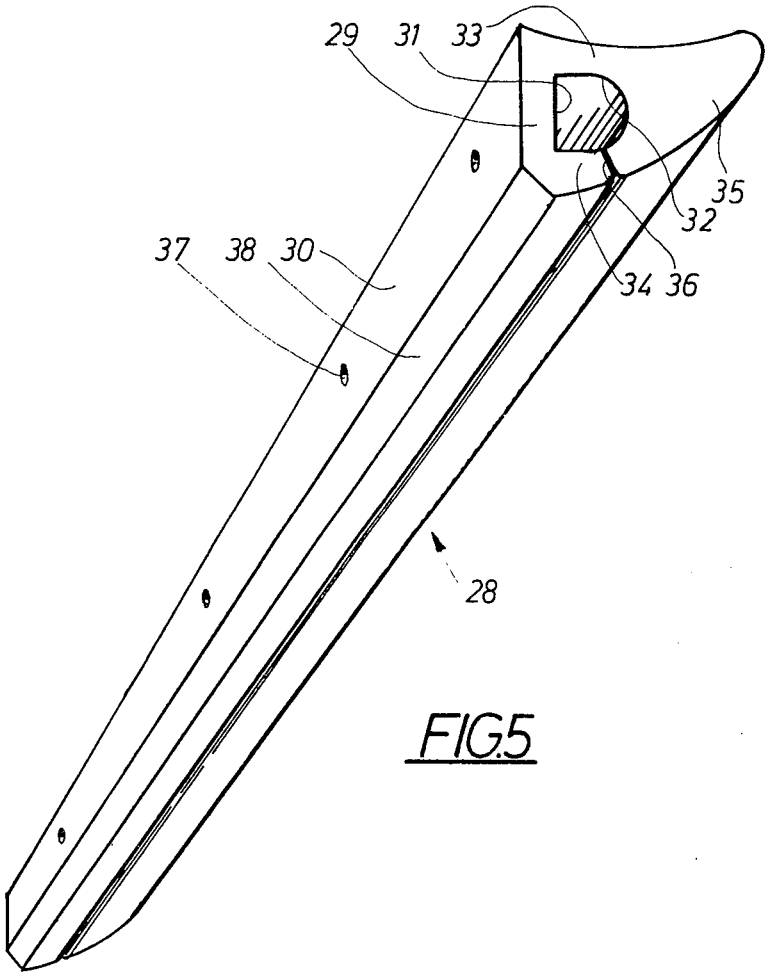

An embodiment of the invention is described in the following, reference being made to the accompanying drawings, in which FIG. 1 shows a cross-section through the arrangement as seen in the longitudinal direction of the road, FIG. 2 is a view of a portion of the cross-section of FIG. 1 on an enlarged scale, FIG. 3 is a top view of the crossing, FIG. 4 is a perspective view of a sleeper used in connection with the invention, and FIG. 5 is a perspective view of a sealing element used in connection with the invention.

According to FIGS. 1 and 3 a road structure 1, here illustrated with a paving 2 of for example bitumen, has a clearing with edges 3 for the passage of a crossing railway track 4. The railway track 4 is shown as a single-track with two rails 5, which are supported by concrete sleepers 6. The paving 2 of the road structure 1 as well as the sleepers 6 of the track 4 are supported by a frost buffering foundation layer, a so-called railway ballast 7.

In order to connect the parts of the road section 1, three concrete slab units extend in the longitudinal direction of the road between the edges 3, two of which, hereinafter called the outer slabs 8, extending along the outside of the two rails 5 of the track and one slab between said rails, in the following mentioned as the center slab 9. In the following the slabs 8 and 9 respectively are mentioned each one as a single slab unit, but they can also comprise a row of slabs in the longitudinal direction of the railway track. They are then divided up in sections because of technical reasons related to their manufacture, transportation and strength, thus forming rows, the number of which is adjusted according to the width of the road structure 1.

However, it is an essential feature of the invention that the slabs have a considerable size, and as mentioned above, they are so wide in the cross direction of the railway track that they extend unbroken between the edge of the road structure and the rail and between the rails respectively. In the longitudinal direction they are preferably given such a dimension that they for example correspond to one half of the intended width for the road structure and in connection with narrow roads even to the whole width. However, when the width of the road is of great proportions the slabs can be divided up in two or more sections, as mentioned above, each one, however, being of considerable length, preferably in the order of magnitude of 6 meters.

According to the invention the center slab 9 is arranged to be supported by the sleepers 6 and to be held in place by the latter ones by means of a locking arrangement comprising a ledge 10 on the slab 9 and a groove 11 in the sleepers. The ledge 10 and the groove 11 with respect to position and fit are arranged in such a manner that the slab 9 will occupy a symmetric position between the rails 5 in such a way that two groove-like spaces 12 well defined as to their width will be formed between the edges of the slab 9 and the rails 5. The slabs 8 are arranged at their inner sides facing the rails 5 to be supported by the sleepers 6 in a locking arrangement, which is formed by a ledge 13 of cylindrical surface located on the sleepers and corresponding to a cylindrical recess 14 along the inner edge of the lateral slabs 8. The respective outwardly facing edges of the lateral slabs 8 are arranged to be supported by two supporting ledges 15 of reinforced concrete and having a foot 16, the width of which is sufficiently large to form a suitable supporting surface against the foundation 7, and moreover a ledgeshaped head 17, which extends upwardly reaching the level of the paving 2 and forming a terminal support for the same. An edge 18 is formed between the head 17 and the foot 16 and is arranged to support the outer edge of each respective slab 8. The rails 5 also have groove-like spaces 19 on their sides facing the outer slabs 8.

As is evident especially from FIG. 2, the rail 5 in the customary manner has a head 20, on the top side of which the wheels of the vehicle are intended to run, a web 21, and a foot 22. The foot 22 is via a resilient pad 23, preferably of rubber, supported in a groove in the sleepers 6. A number of clamping means 25 and 26 of spring steel are provided to hold the rail, said clamping means being fastened to the sleepers by means of expanding bolts 27 or similar. Grooves 28 and 29 respectively (FIG. 4) are recessed in the sleepers for the clamping means 25 and 26.

The space 12 is intended to offer a clearance for the flanges of the wheels of the railway vehicle, and it must permit these wheels to reach a certain depth. Against this demand is the desire that the space in question is kept unobstructed by dirt, mud and other material, so that the flanges are given sufficient room. In order to satisfy the demand for a free accessability for the wheel flanges to the space 12 and at the same time avoid the falling down of undesired material in the same, it is provided with a resilient sealing strip 28, preferably made of rubber. According to FIG. 5 the strip 28 has a lateral wall 29 with an outer substantially plane surface 30 and an inner surface 31 bordering on a space 32. Walls 33 and 34 project from the wall 29 on both sides of the space 32 and are connected in a lip-shaped projection 35 with a curved edge that in the mounting position is upwardly bent. The wall 34 is divided by a groove 36, and the wall 29 is perforated by a number of holes 37. A chamfer 38 extends along the outer sides of the walls 29 and 34.

As is evident from FIG. 2, the slab 9 also is provided with a projection 39, against which the chamfer 38 can rest in order to guide the sealing strip 28, which is attached to the slab 9 by means of expanding bolts 40, the heads of which are inside the space 32 and the shafts of which extend through the holes 37. For the mounting work the bolt heads are accessible through the groove 36, which can be widened by raising the portion 35. In mounted position the portion 35 is stretched by the underside of the rail head 20.

The space 19 serves the purpose to permit the rail 5 and the slab 8 a free play for sinking movements, thrusts and vibrations, which arise in traffic situations, and for movements due to differences of thermal expansion and contraction arising as a result of the rail being made of steel and the slab of concrete. However, it is desirable that also the space 19 is sealed off, so that dirt will not accumulate in the same. Such accumulation could in fact lead to the different parts being displaced to each other as a result of stresses caused by frost. In order to seal off the space 19, a sealing strip 41 of rubber is attached to each respective slab 8 by means of expanding bolts 42. However, the sealing strip 41 does not need to perform any movement sideways and therefore has the shape of an element just squeezed in place between the rail and the sides of the slab.

The embodiment has been shown as relating to a crossing at a single track point. However, the invention can easily be adapted to crossings comprising several tracks. The respective outer edges facing the termination of the paving in such connection acquire the same appearance, as is shown in connection with the embodiment described. Also the slab 9 between the rails and the sealing means can be unchanged. However, between the rails the slabs are suitably similar to the slabs 8, but of symmetric shape at both edges, i.e. having cylindrical recesses corresponding to the recess 14, so that the slab extends between the ends of two sleepers belonging to different rails.

In practice movements of parts cannot be avoided in the crossing. Such movements arise because of sinking phenomena aggravated by the road and rail traffic passing the crossing and because of movements caused by frost. However, the slabs 8 and 9 forming the road structure in the crossing will all the time follow the sleepers 6. As has been evident, the slab 9 is completely supported by the sleepers 6 and therefore entirely follows the movement of them, whereby the plane of the slab, which is level with the running surface of the rail head 20, always maintains this position, so that any detrimental difference in height between these surfaces will not arise. Also the slabs 8 at their edge facing the rail 5 are supported by the sleepers 6 by the cylindrical surfaces 13, 14. On the other hand the outer edges are supported by the supports 15 embedded in the paving 2. This means that the slab 8 at its edge bordering on the rail always will be connected flush with the top side of the same at the same time, as it is level with the paving 2 irrespective of any differences in the way the movements of the paving and sleepers take place, which is a quite common phenomenon. In connection with such unequal movements the slab 8 can pivot round the cylindrical surfaces 13, 14 so that any movements, which could cause breakages, will not arise at the same time as the bottom surface of the slab 8 at its outer edge can perform a wobbling movement against the surface 18 of the support 15. The lateral movements of the vertical edge of the slab 8 facing the rail, which arise in connection with a pivoting of the slab round the cylindrical surfaces 13, 14 are taken up by the resilient sealing strip 41. In said arrangement in connection with a double track the slabs extending between the rails perform a corresponding pivoting movement, if settling movements of different magnitude will occur in the ground along the different rails.

When a railraod vehicle is passing the crossing, its wheel flanges travel above the sealing strip 28, the height position of which is determined in accordance therewith. However, the strip impedes dirt from falling down in the deeper portion of the space 12. In the shallow groove, the bottom of which is formed by the sealing strip, the main part of accumulated material will be blown away when a railroad vehicle is passing. However, if on any occasion this space should be so filled up by solidified or frozen material that the space for wheel flanges would be taken up, said flanges can, however, press down the accumulated material, while the strip due to its resilience yields. The running performance of the wheel is not affected thereby, which can be the case in conventional solutions, if the space has been packed full all the way down to its bottom with clay, dirt, and other material, especially if this material is frozen.

Thus, the sealing strips 28, 41 for the spaces 12, 19 in any case to a substantial extent impede the falling down of dirt and other material into the spaces. This is of importance, as the electric loss current developing in the sleepers on account of the signal voltage existing in the rails will not be unnecessarily amplified. Especially when there is material containing salt on the road, such as salty snow slush, surrounding the rail clamping means, it gives rise to such amplification, which in its turn leads to corrosion of the concrete sleepers by galvanic currents.

When a crossing shall be constructed, first the track will be applied and in connection with the application of the road structure, the supporting ledges 15 are put in place. The slabs 8 and 9 are thereafter by means of a hoist lowered down on the foundations shaped by the sleepers 6 and the supporting ledges 15. Any adjustment is not necessary because of the connecting arrangements formed by the projections 10 and 13. As mentioned, the length of the slabs 8, 9 is so great that the whole width of the road structure is covered by one or a few slabs in the longitudinal direction of the railway. These large slabs moreover make possible their manufacturing by rational methods in machines with a minimum of manual work.

A possible maintenance work in a crossing is the cleaning of the space 12 for the wheel flanges. This is easy to carry out by means of a tool in the very shallow space shaped by the ledge 28. Another absolutely necessary maintenance work is the adjustment of the sleepers and tamping of ballast. The crossing due to its construction is easy to prepare for this work, as the large slabs 8, 9 are lifted up by means of a hoist. In this connection the arrangement according to the invention, in which the sealing strips 28 and 41 are attached to the slabs, is an important feature, as no demounting work is necessary; the sealing strips just accompany the slabs in the hoisting movement and the track is laid free. In connection therewith the space 12 under the sealing ledge 28 will be easily accessible for cleaning work, in case the flanges should have pressed down any material past the sealing strip. When the slabs 8, 9 again shall be put in place, it is just as simple to carry out this work as when a new construction of a crossing is made because of the positioning means incorporated in the sleepers and the supporting ledges.

Thus, the objects mentioned in the preamble have been reached by means of an arrangement according to the invention, and a crossing has been attained, in which high demands for convenience and security in crossing are satisfied, while the least possible maintenance work is required. Within the scope of the following claims the means according to the invention can be adjusted to different desired objects and conditions. Thus, the parts can be adapted for crossings, which do not occur at right angle. The invention is neither dependent on the materials mentioned, nor on the type of rail clamping shown.

We claim:

1. Arrangement at a crossing between a road and a railway, where the road is interrupted at two opposite edges, between which is positioned at least one railroad track, said arrangement comprising a row of sleepers for supporting the rails of the track and arranged substantially perpendicular to the rails, said sleepers resting on a foundation, first slabs being located in the area between the rails and the respective edge of the road, and a second slab positioned between the rails, said slabs having top surfaces substantially level with top surfaces of the rails and top surfaces of the road, said sleepers having top sides provided with two first supporting surfaces with locking means each provided to support and position one of the rails, two second supporting surfaces and locking means, each being integral with said sleepers and positioned on the outside of one of said first supporting surfaces and each in the form of a sector of a cylinder turned upwardly and with its axis extending perpendicular to the longitudinal direction of the sleeper, a central supporting surface with locking means integral with said sleeprs and between said first surfaces; and elongated supporting elements to rest on the foundation and provided wth a first edge to which the road structure adjoins and a second edge opposite to the first edge with a supporting surface; said first slabs each being provided at its underside with a first resting surface adapted to cooperate with the cylindrical resting surfaces of said sleepers in order to form a supporting bearing allowing the respective first slab to pivot, and a resting surface provided to cooperate with the supporting surface on the respective elongated element, and said second slab being provided at its underside with a resting surface adapted to cooperate with said central supporting surfaces and locking means of said sleepers for supporting and locking said second slab.

2. The arrangement according to claim 1, wherein said second slab is narrower than the distance between the rails so that groove-like spaces are formed between the rails and the edges of the second slab, a resilient sealing strip for covering said spaces being attached to the edge of said second slab, said strip projecting from the edge of said second slab and establishing a resilient contact with the rail, at the underside of the head of the respective rail thereby covering the groove-like space.

3. The arrangement according to claim 2, in which the sealing strip is provided with a surface, attached to the edge of the second slab and which is formed by a wall bordering on a space housing heads of attaching bolts projecting through the wall and penetrating into the edge of the second slab.

4. The arrangement according to claim 2, in which the edges of the first slabs terminate at a distance from the respective rail so that a groove-shaped space is formed between said edge and the adjacent rail, and a resilient sealing strip provided in said groove-shaped space.

* * * * *